United States Patent [19]

Iwahashi et al.

[11] 4,134,370

[45] Jan. 16, 1979

[54] ENGINE WITH AIR-COOLED NON-CONTACT IGNITION SYSTEM

[75] Inventors: Toshio Iwahashi; Kouji Nakai; Yoshio Tani, all of Osaka, Japan

[73] Assignee: Kubota, Ltd., Osaka, Japan

[21] Appl. No.: 789,299

[22] Filed: Apr. 20, 1977

[30] Foreign Application Priority Data

Jan. 24, 1977 [JP] Japan ..... 52-7139

[51] Int. Cl.[2] ..... F01P 1/06

[52] U.S. Cl. ..... 123/41.31; 123/41.6; 123/143 C; 123/198 E; 123/55 VF; 123/41.65

[58] Field of Search ..... 123/41.65, 41.6, 41.69, 123/55 V, 55 VE, 55 VS, 55 VF, 52 MC, 148 CC, 143 C, 41.31, 198 E, 195 E, 195 C

[56] References Cited

U.S. PATENT DOCUMENTS

| | | | |
|---|---|---|---|
| 1,555,807 | 9/1925 | Burtnett | 123/41.6 |
| 2,052,017 | 8/1936 | Doman | 123/41.6 |
| 2,784,244 | 3/1957 | Hines | 123/41.31 X |
| 2,798,471 | 7/1957 | Kiekhaefer | 123/41.31 X |
| 3,623,467 | 11/1971 | Piteo | 123/148 CC X |
| 3,741,186 | 6/1973 | Doi et al. | 123/148 CC X |
| 3,765,390 | 10/1973 | Loudon et al. | 123/148 CC |

FOREIGN PATENT DOCUMENTS

| | | | |
|---|---|---|---|
| 1249585 | 9/1967 | Fed. Rep. of Germany | 123/198 E |
| 497371 | 9/1919 | France | 123/41.31 |

*Primary Examiner*—Ronald H. Lazarus
*Assistant Examiner*—Jeffrey L. Yates
*Attorney, Agent, or Firm*—Bacon & Thomas

[57] ABSTRACT

A V-shaped, air-cooled engine is provided with a cover on the front thereof, which houses a cooling fan connected to the engine's crankshaft. The interior of the cover is fitted with dividers to separate the air flow and direct it to the opposite sides of the engine, and to form a compartment for housing components of a non-contact ignition system. The non-contact ignition system is operated by the cooling fan, and is cooled by the flow of air through the cover. Components of the ignition system are permanently connected to each other, without the usual separable connectors.

6 Claims, 5 Drawing Figures

ENGINE WITH AIR-COOLED NON-CONTACT IGNITION SYSTEM

BACKGROUND OF THE INVENTION

1. Field of the Invention

The present invention relates generally to air-cooled engines, and ignition systems therefor. More particularly, it relates to an improved air-cooled, V-shaped engine provided with a non-contact ignition device, wherein the ignition apparatus is air-cooled to prevent damage thereto from overheating, and is shielded from foreign objects directed theretoward.

2. Description of the Prior Art

Air-cooled engines are known, and several designs have been proposed therefor. In the conventional air-cooled engine, a generator, a non-contact controller, the ignition coils and the ignition plugs are separately located on the body of the engine. Thus, the components of the non-contact ignition system are scattered, and separable connections are made therebetween by the use of often lengthy wires and separable connectors. Moreover, components of the system like the elements of the non-contact controller and the ignition coils are normally mounted directly on the crankcase, where they are exposed to excessive heat that can cause failure.

The conventional arrangement for an air-cooled engine just described suffers from certain inherent disadvantages. The requirement for a number of terminals and leads can create connection errors, which can lead to equipment failure, and connections can become loose due to engine vibration. In addition, conventional separable connectors are a common source of electrical leakage, especially when under invasion by oil or water.

Further, the normal placement of ignition system components on the crankcase, as has been noted, exposes them to high engine heat that can cause failure. In addition, the components are often mounted in exposed, projecting positions, and as a result are sometimes damaged because of contact with foreign objects.

There is thus need for an improved design for an air-cooled engine, one that will eliminate the noted problems with the conventional engine of this type. The present invention is intended to satisfy that need.

SUMMARY OF THE INVENTION

In the present invention the front of an air-cooled, V-shaped engine is fitted with a cover, secured to a common mounting plate carried by the crankcase. The cover houses a cooling fan mounted on the front end of the crankshaft, and is fitted with internal dividers that serve to direct the air flow toward the opposite sides of the engine, and which form a partially enclosed compartment at the top of the cover in which a non-contact controller and the ignition coils are housed, these elements of the ignition system being fixed to the mounting plate. The generator is incorporated into the cooling fan structure, and all connections are permanently made so that no separable connectors are required.

The ignition system components are thus positioned to be cooled by the air flow generated from the cooling fan, and are protectively housed. Further, there are no separable connectors to come loose from vibrations, or to be affected by the presence of oil or water.

It is an object of the present invention to provide an improved design for a V-shaped, air-cooled engine, wherein the ignition system is mounted in a protected position and the components thereof are arranged to be cooled by a flow of cooling air.

Another object is to provide an ignition system arrangement wherein the components thereof are permanently connected to each other, so that separable connectors are eliminated.

Yet another object is to provide a V-shaped, air-cooled engine wherein the cooling air flow is generated by a cooling fan mounted on the crankshaft, and is directed evenly to the opposite sides of the engine.

A further object is to provide a cooling fan and cover arrangement for a V-shaped, air-cooled engine, wherein the flow of cooling air through the cover is evenly separated, and a means is provided to allow foreign objects injested by the fan to be safely ejected.

Other objects and many of the attendant advantages of the present invention will become readily apparent from the following Description of the Preferred Embodiment, when taken in conjunction with the accompanying drawings.

DESCRIPTION OF THE PREFERRED EMBODIMENT

Figure 1:
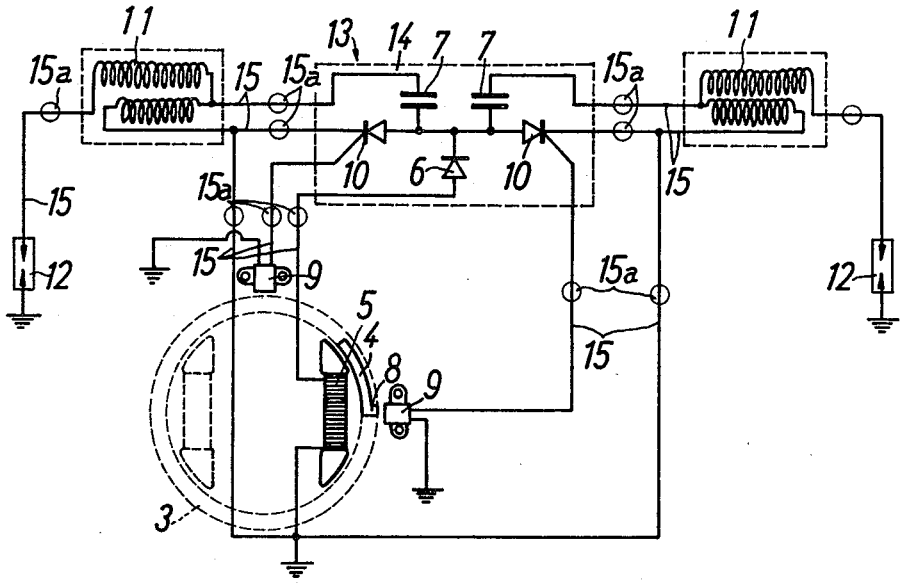
FIG. 1 is a circuit diagram, showing the arrangement of the ignition system of the invention.
Figure 3:
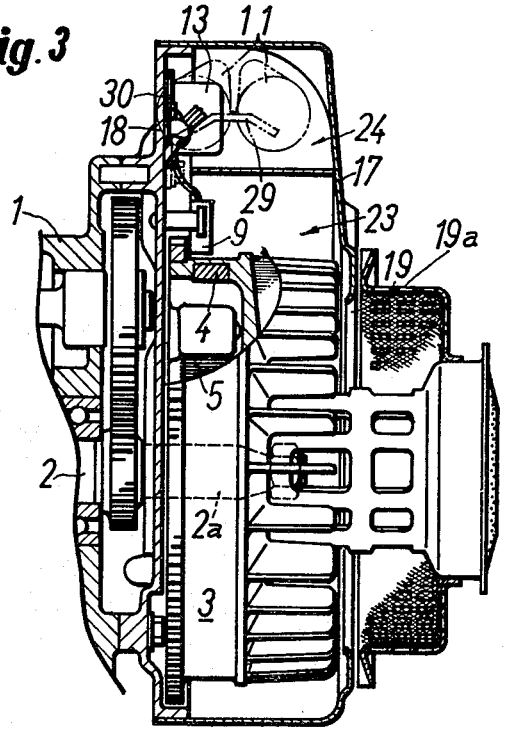
FIG. 3 is a vertical cross-sectional view, taken generally on the line III—III of FIG. 2, and further showing the cover and components housed therewithin.

Referring now to FIGS. 1–4 in particular, the electrical ignition system of the present invention is illustrated therein, and is of the capacitor discharge ignition type, commonly called a C.D.I. system.

The engine of the invention includes a crankcase 1 within which a crankshaft 2 is rotatably mounted, the front end 2a of the crankshaft projecting from the front face of the engine and having a flywheel cooling fan 3 mounted thereon. The cooling fan incorporates the geneator structure, and for this purpose the flywheel fan 3 includes a cylindrical rim on which is mounted a magnetic steel generating plate 4, arranged to be revolved about an exciter or generating coil 5 fixed to the front wall of the crankcase 1 as the crankshaft 2 rotates the flywheel fan 3.

As the generating plate 4 revolves about the exciter coil 5, an A.C. current is generated, which current is converted into a D.C. current by a diode 6. The D.C. current thus generated is stored in a capacitor 7, one for each ignition plug 12 of the engine. A pulser coil 9 is mounted on the crankcase to confront the periphery of the flywheel fan 3, one for each capacitor 7, and the flywheel fan 3 carries a steel core 8. During rotation of the flywheel fan 3, the steel core 8 will excite the pulser coils 9 in sequence, causing them to generate signals which are transmitted to silicon controlled rectifiers 10, energizing the latter and thus enabling the capacitors 7 to be discharged in sequence. When the capacitors 7 are discharged through their ignition coils 11, their associated ignition plugs 12 are energized.

In the invention, the diode 6, the capacitors 7, and the silicon controlled rectifiers 10 are all embedded in a carrier made of a suitable insulating plastic material to form a C.D.I. or noncontact controller unit 13. Thus, they are permanently mounted, and are protected from damage.

The exciter or generating coil 5, the pulser coils 9, the C.D.I. or noncontact controller unit 13, the ignition coils 11 and the ignition plugs 12 are all connected to one another by lead wires 15. In the conventional arrangement the wires 15 would be cut at the places indicated by the small circles 15*a* in FIG. 1, and would be separably connected by the usual separable connectors. In the present invention, no such connectors are employed at the locations 15*a*. Rather, the components are permanently connected by leads 15 having no interruptions therein. This arrangement, made practical in part by the unique manner in which the components of the invention are arranged, eliminates the problems with electrical leakage that commonly occur through the use of such separable connectors.

Turning now to the structure of the V-shaped engine of the invention, such includes a pair of cylinders 16 mounted on the opposite sides of the crankcase 1 to form a letter "V", each of the cylinders 16 having cooling fins 16*a* thereon. The flywheel fan 3 and the area surrounding it are covered by a cover 17, designed to introduce a flow of cooling air into the engine. The cover 17 is bolted to a mounting plate 18 that is formed integrally with the crankcase 1, and has a central air inlet opening 19 in the front face thereof which is covered by an anti-dust cover 19*a*. The rear face of the cover 17 has two air outlet openings 20 therein, one on each side of the crankcase 1, and which face toward the cylinders 16.

The finned portions of the cylinders 16 are covered by arcuate, elongated enclosures 21, into which the openings 20 open. The enclosures 21 serve to guide cooling air over the cooling fins 16*a*, after which the flow of air passes rearwardly from the engine, the rear ends of the enclosures 21 being open to facilitate such flow.

The engine of the invention includes a disc-shaped air cleaner 26, removably mounted on a down-draft type of carburetor 26. An exhaust pipe 27 leads from each piston 16, and said pipes terminate in a muffler 28 mounted at the rear of the engine. In operation, the crankshaft 2 of the engine revolves the flywheel fan 3, which operates the non-contact ignition system of the invention, and also draws cooling air in through the opening 19 and passes it into the enclosures 21 through the openings 20. The cover 17 is especially designed to facilitate the flow of cooling air in an optimum manner, and also serves to house the C.D.I. unit 13 and the ignition coils 11.

The cover 17 has curved wall portions 17*a* on both sides thereof, near its top corners (FIG. 5), and therebetween the front face of the cover includes a vertical wall portion 17*b*. The curved wall portions 17*a* serve to guide air flow within the cover 17, to direct it toward the openings 20. To further guide such air flow, the interior of the cover 20 is fitted with a divider member 22, which separates the interior thereof into right and left hand air flow chambers 23, and a compartment 24 located above the divider 22 and behind the vertical wall portion 17*b*. The compartment 24, while spaced from the flywheel fan 3 and shielded by the divider 22 against foreign objects that might be hurled by the fan, is nevertheless cooled by air flowing over the divider.

The right and left hand air flow chambers 23 leading to the openings 20 should be of approximately equal size, so as to provide the same amount of cooling air flow to the cylinders 16 on the opposite sides of the engine, whereby both sides will be cooled approximately equally. This is achieved in the invention by the placement of the divider 22, and a second divider 34.

Figure 2:
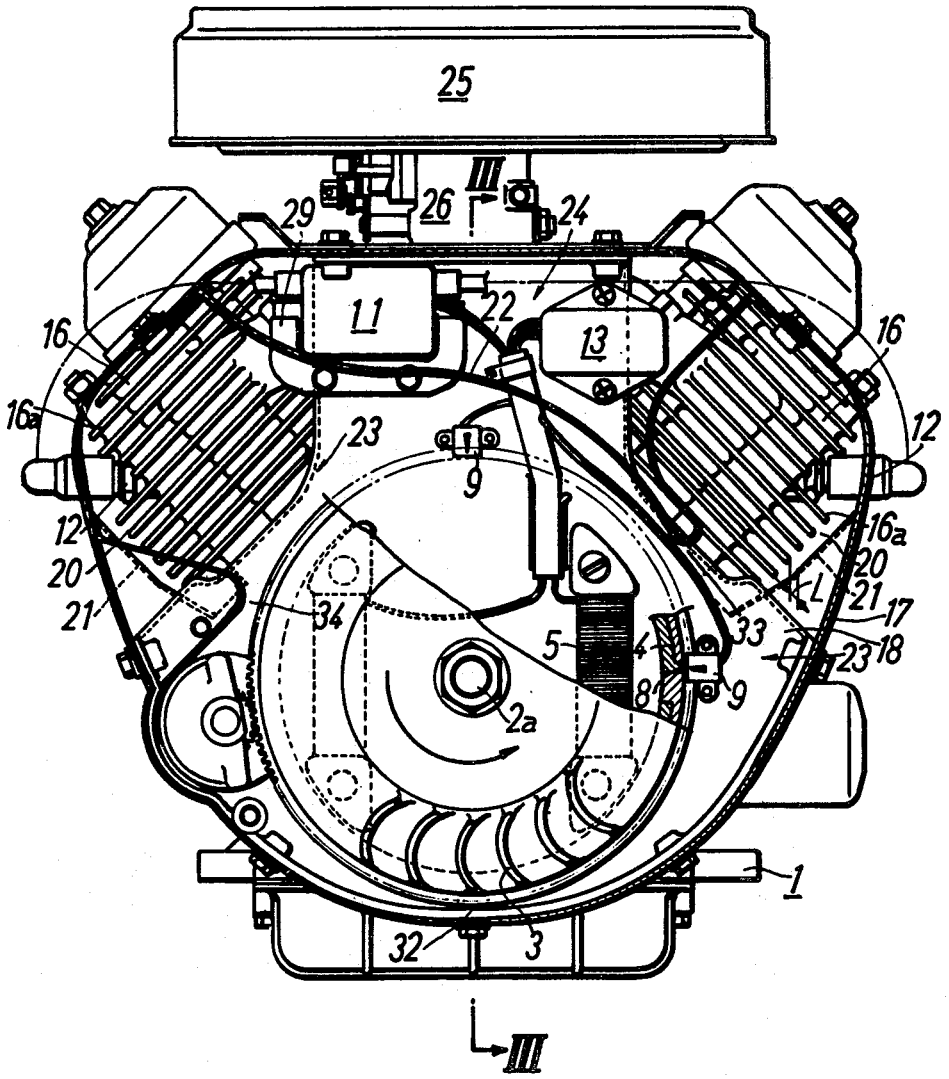
FIG. 2 is a vertical sectional view taken through the cover mounted on the front face of the V-shaped engine of the invention, showing the arrangement of the interior of the cover, and its relationship to other components of the engine, the cooling fan being partially broken away to show the exciter coil and other elements of the electrical ignition system.
Figure 4:
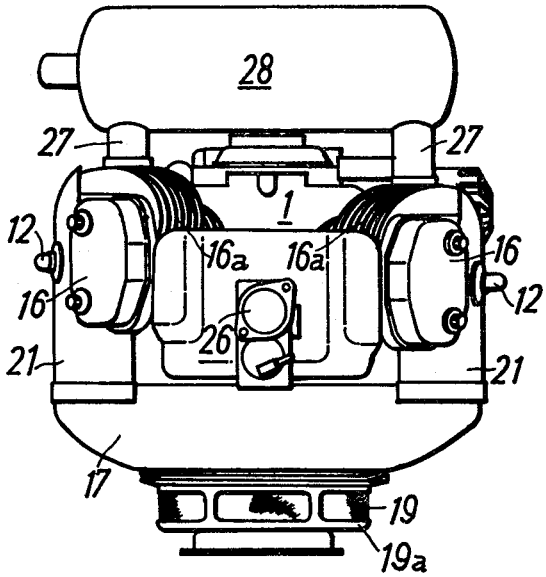
FIG. 4 is a plan view of the engine of FIG. 1, with the air cleaner removed therefrom.
Figure 5:
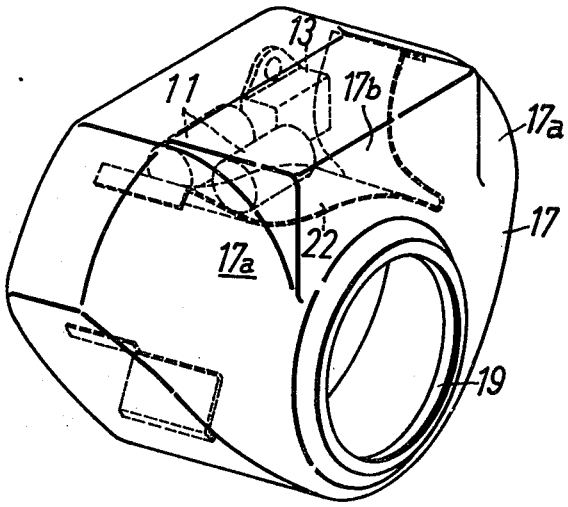
FIG. 5 is a perspective view of the front cover of the engine.

Referring to FIGS. 2 and 5, the bottom of the cover is closely spaced to the flywheel fan 3 at a point 32 directly below the crankshaft 2, and the fan is shown to be rotatable in a counterclockwise direction. The divider 22 is placed above the flywheel fan 3, and is connected at its outer ends to the upper corners of the cover 17. The divider 22 has a reverse bend 33 formed therein and which is located on the right side of the flywheel fan 3, this bend defining the counterclockwise limit or end of the area of the right hand air flow chamber 23. More particularly, the right hand air flow chamber 23 is open to the flywheel fan over an arc length leading from the point 32 at the base of the cover, to the reverse bend 33.

It has been found that for good performance the reverse bend should be located at a point between 15° and 45° measured from a horizontal line passing through the axis of the crankshaft 2. The reverse bend 33 not only forms the end point of the right hand air flow chamber 23, but the beginning point of the left hand flow chamber 23.

The end of the left hand flow chamber 23 is defined by the V-shaped divider 34, the point of the "V" formed thereby being directed toward and closely spaced from the flywheel fan 3. In order to provide substantially equal air flow through the two chambers 23, the point of the V-shaped divider 34 should be positioned between 10° and 45° from a horizontal line passing through the axis of the crankshaft 2. This will provide substantially equal arc length exposure of the chambers 23 to the cooling fan 3.

The compartment 24 formed above the divider 17 and behind the vertical wall 17*b* is utilized to house the two ignition coils 11 and the C.D.I. unit 13. The two coils 11 are preferably combined into a single unit, and are mounted on the plate 18 by a bracket 29 bolted thereto. The C.D.I. unit 13 is bolted to the plate 8, through a body of insulating material 30. The C.D.I. unit 13 and the coils 11 are thus protected from damage, and as has been explained, are air cooled to prevent failures from overheating.

The formation of the portions 17*a* and 17*b* on the cover 17 serve an additional function, in that the cover is thus strengthened against vibration and the like, and forms a cover that effectively confines engine noise. Between the enclosures 21 and the fins 16*a* of the cylinder 16, gaps L are provided for enabling foreign objects injested by the flywheel fan 3 to escape by being blown therethrough. This feature is especially important when the engine is used for agricultural purposes, where small pieces of straw and similar foreign matter may enter the cover 17 after having evaded the anti-dust cover 19*a*. The gaps L help eliminate clogging of the cooling fins 16*a* with such injested foreign material, thereby assuring proper cooling of the cylinders, and preventing the outbreak of a fire caused by engine heat combusting material trapped in the cooling fins.

Obviously, modifications and variations of the invention are possible.

What is claimed is:

1. An air-cooled, V-shaped engine, including:

a crankcase having cylinder means mounted on the opposite sides thereof to form a V-shape, said cylinder means being provided with cooling fins, and said crankcase further having a mounting plate on the front end thereof;

a crankshaft rotatably mounted in said crankcase, the front end of said crankshaft projecting forwardly from said mounting plate;

a flywheel fan mounted on the projecting front end of said crankshaft;

a cover secured to said mounting plate and covering said flywheel fan, said cover having air inlet opening means thereon, and two air outlet openings in its rear end, one on each side of said crankcase;

enclosure means mounted on each side of said crankcase, each adapted to receive cooling air from one of said air outlet openings and to channel it to flow over the cooling fins of the cylinder means associated therewith;

divider means within said cover, arranged to divide said cover into two chambers, one associated with each of said outlet openings, and a compartment having its interior shielded from said flywheel fan by said divider means; and a non-contact ignition system connected and arranged to operate said engine, said system including an ignition plug associated with each of said cylinder means, an ignition coil associated with each of said ignition plugs, generator means incorporated in said flywheel fan, and a non-contact controller unit connected with said generator means and said ignition coils;

said generator means, said ignition coils and said non-contact controller unit being housed within said cover, with said ignition coils and said non-contact controller unit being housed within said shielded compartment defined between said divider means and said cover.

2. An air-cooled, V-shaped engine as recited in claim 1, wherein said generator means includes a generator coil attached to said mounting plate and received within said flywheel fan, said flywheel fan including a cylindrical rim carrying a magnetic steel generating plate arranged to revolve about said generator coil, and said generator means, said non-contact controller unit, and said ignition coils being connected to one another with leads and without the use of separable connectors.

3. An air-cooled, V-shaped engine as recited in claim 1, wherein said divider means is arranged to divide the interior of said cover into two chambers having approximately the same arc length of exposure to said flywheel fan.

4. An air-cooled, V-shaped engine as recited in claim 3, wherein the front face of said cover has curved portions at its upper, outer corners that serve to help guide cooling air through said outlet openings, and a generally vertical wall portion above said divider means forming the front wall of said compartment.

5. An air-cooled, V-shaped engine as recited in claim 1, wherein said air inlet opening means comprises a central opening in the front of said cover, fitted with anti-dust filtering means.

6. An air-cooled, V-shaped engine as recited in claim 1, including additionally a gap formed between said enclosure means and the cooling fins of their associated cylinders, arranged to allow the cooling air to blow away foreign matter injested by said flywheel fan and entrained in the cooling air directed at said cooling fins.

* * * * *